US007751770B2

(12) United States Patent
Miyamoto et al.

(10) Patent No.: US 7,751,770 B2
(45) Date of Patent: Jul. 6, 2010

(54) IMAGE FORMING APPARATUS AND RECOVERY ROLLER

(75) Inventors: Hidetoshi Miyamoto, Osaka (JP); Kouji Uno, Osaka (JP); Minoru Wada, Osaka (JP)

(73) Assignee: Kyocera Mita Corporation (JP)

( * ) Notice: Subject to any disclaimer, the term of this patent is extended or adjusted under 35 U.S.C. 154(b) by 685 days.

(21) Appl. No.: 11/638,724

(22) Filed: Dec. 14, 2006

(65) Prior Publication Data

US 2007/0140727 A1 Jun. 21, 2007

(30) Foreign Application Priority Data

Dec. 15, 2005 (JP) ..... 2005-361646

(51) Int. Cl.
*G03G 21/00* (2006.01)

(52) U.S. Cl. ..... 399/357; 399/343; 399/344; 399/345

(58) Field of Classification Search ..... 399/99, 399/101, 123, 343–345, 349–351, 353, 357
See application file for complete search history.

(56) References Cited

U.S. PATENT DOCUMENTS

| | | | | |
|---|---|---|---|---|
| 6,035,158 | A * | 3/2000 | Asakura et al. | 399/101 |
| 7,477,862 | B2 * | 1/2009 | Takaya et al. | 399/100 |
| 2001/0031159 | A1 * | 10/2001 | Ogiyama et al. | 399/101 |
| 2004/0126692 | A1 * | 7/2004 | Yamanouchi et al. | 430/110.3 |
| 2005/0220478 | A1 | 10/2005 | Ai et al. | |

FOREIGN PATENT DOCUMENTS

| | | |
|---|---|---|
| JP | 10-074028 | 3/1998 |

* cited by examiner

*Primary Examiner*—David M Gray
*Assistant Examiner*—Ruth N Labombard
(74) *Attorney, Agent, or Firm*—Gerald E. Hespos; Michael J. Porco

(57) ABSTRACT

Disclosed is an image forming apparatus, which comprises an image bearing member on which a toner image is formed, a sweep roller for removing residual toner particles from the image bearing member, and a recovery roller for recovering the toner particles from the sweep roller. The recovery roller has a diameter of 10 mm or less, and a surface roughness Rz of 1.6 μm to 6.4 μm.

13 Claims, 9 Drawing Sheets

| DATE | 05/06/21 | Ra | 0.5627 μm |
|---|---|---|---|
| STANDARD OF CALCULATION | JIS-'94 STANDARD | Ry | 4.3520 μm |
| MEASUREMENT TYPE | ROUGHNESS MEASUREMENT | Rz | 3.2954 μm |
| MEASUREMENT LENGTH | 4.0mm | Rmax | 6.0000 μm |
| CUT-OFF WAVELENGTH | 0.8mm | Rt | 5.9760 μm |
| MEASUREMENT MAGNIFICATION | × 5K | Sm | 55.2257 μm |
| MEASUREMENT VELOCITY | 0.15mm/s | | |
| CUT-OFF TYPE | GAUSSIAN | | |
| SLOPE CORRECTION | LEAST-SQUARE LINEAR CORRECTION | | |

IMAGE FORMING APPARATUS AND RECOVERY ROLLER

BACKGROUND OF THE INVENTION

1. Field of the Invention

The present invention relates to an image forming apparatus and a recovery roller for use therein.

2. Description of the Background Art

A conventional image forming apparatus is equipped with a sweeping system for sweeping an image bearing member, such as a photosensitive drum or an intermediate transfer belt, by removing toner particles remaining on the image bearing member after transferring a toner image formed on the image bearing member, onto a sheet.

As such a sweeping system, there has been known a sweeping system 100 as shown in FIG. 9. This sweeping system is intended to remove residual toner particles from an intermediate transfer belt 102 being rotated by a drive roller 101.

This sweeping system 100 is disposed on a downstream side of a transfer roller 103 on the basis of a rotation direction of the intermediate transfer belt 102, and provided with a fur brush 104 in contact with the intermediate transfer belt 102. The sweeping system 100 further includes a recovery roller 105 in contact with the fur brush 104, and a rubber blade 106 in contact with the recovery roller 105.

In the above sweeping system 100, toner particles remaining on the intermediate transfer belt 102 without being transferred onto a sheet in the transfer roller 103 are removed by the fur brush 104. Then, the toner particles on the fur brush 104 are recovered by the recovery roller 105. Further, the toner particles on the recovery roller 105 are removed therefrom by the rubber blade 106.

In recent image forming apparatuses, with a view to improving transfer efficiency of a toner image formed on an image bearing member, toner particles are used which have a high roundness, a small volume-average particle diameter, and a low variation coefficient of number distribution (see, for example, Japanese Patent Laid-Open Publication No. Hei 10-74028).

Recent years, with the progress of downsizing of image forming apparatuses, there is also an increasing need for reduction in size of a sweeping system. In reality, if a diameter of a recovery roller 105 is reduced to downsize a sweeping system 100, the recovery roller 105 will become more susceptible to bending. This bending amount is affected by a third power value of a roller diameter. That is, the bending amount sharply increases as the diameter of the recovery roller 105 is reduced. If the recovery roller 105 has increased bendability, a pressing force of a rubber blade 106 against the recovery roller 105 will become uneven in a longitudinal direction (a direction perpendicular to the drawing sheet).

Specifically, the pressing force of the rubber blade 106 against the recovery roller 105 becomes lower a in longitudinally central region of a surface of the recovery roller 105 as compared with longitudinally opposite end regions thereof, and consequently toner particles on the central region are likely to remain without being removed.

If the rubber blade 106 is pressed against the recovery roller 105 in such a manner as to provide a sufficient pressing force to the central region, the end regions will have an excessively strong pressing force, which is likely to generate "blade noise". Moreover, the excessively strong pressing force is likely to accelerate wear of the rubber blade 106.

Further, in the sweeping system illustrated in FIG. 9, depending on a surface profile of the recovery roller 105, toner scattering is likely to occur during the process of recovering toner particles from the fur brush 104 to the recovery roller 105.

In use of the aforementioned toner particles having a high roundness, an amount of toner to be recovered by a sweeping system will be reduced because of higher transfer efficiency. When the toner particles also have a low variation coefficient of number distribution, i.e., a uniformed toner particle diameter, the toner amount to be recovered will be further reduced.

In the sweeping system, toner particles also serve as lubricant between the rubber blade 106 and the recovery roller 105. Thus, if the toner amount to be recovered is reduced, the "blade noise" in the rubber blade will become increasingly prominent.

The recovery roller 105 is designed to electrically recover toner particles. Thus, when toner particles have a smaller volume-average particle diameter, or a higher charge amount, an adhesion force between the recovery roller 105 and the toner particles will be increased. This leads to the need for further increasing a pressing force of the rubber blade 106, causing increase in the level of blade noise and the amount of blade wear.

SUMMARY OF THE INVENTION

It is an object of the present invention to provide an image forming apparatus having a recovery roller capable of achieving reduction in the level of blade noise or the amount of blade wear.

In order to achieve this object, according to a first aspect of the present invention, there is provided an image forming apparatus which comprises an image bearing member on which a toner image is formed, a sweep roller for removing residual toner particles from the image bearing member, and a recovery roller for recovering the toner particles from the sweep roller. The recovery roller has a diameter of 10 mm or less, and a surface roughness Rz of 1.6 μm to 6.4 μm.

It is another object of the present invention to provide an image forming apparatus having a recovery roller capable of suppressing the scattering of toner particles.

In order to achieve this object, according to a second aspect of the present invention, there is provided an image forming apparatus which comprises an image bearing member on which a toner image is formed, a sweep roller for removing residual toner particles from the image bearing member, and a recovery roller for recovering the toner particles from the sweep roller. The recovery roller has a surface roughness Rz of 1.6 μm to 6.4 μm, and a load length rate of 70% or more when a cutting level is 30% in a load curve obtained by a measurement of the surface roughness.

DETAILED DESCRIPTION OF THE PREFERRED EMBODIMENTS OF THE INVENTION

With reference to the drawings, an image forming apparatus according to an embodiment of the present invention, and a specific example of a recovery roller, will now be described.

An image forming apparatus according to the present invention will be specifically described based on one example where the present invention is applied to a color printer as one type of image forming apparatuses. Initially, the structure and operation of a color printer will be briefly described.

Figure 1:
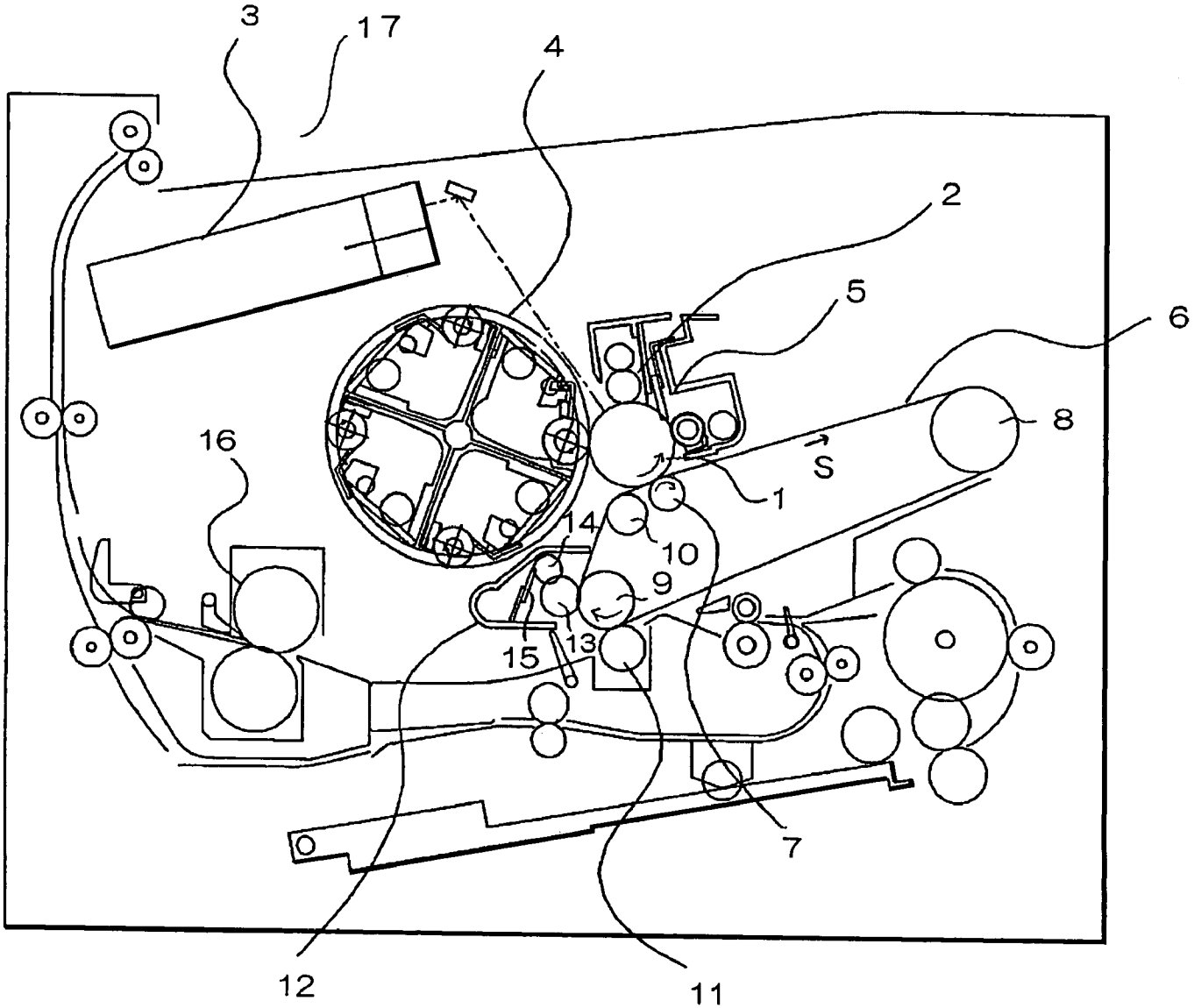
FIG. 1 is a side sectional view of an image forming apparatus according to a first embodiment of the present invention.

FIG. 1 is a side sectional view of a color printer according to a first embodiment of the present invention. As shown in FIG. 1, the printer according to the first embodiment comprises a photosensitive drum 1, and, an electrostatic charger 2, a laser scanning unit 3, a development rotary 4 supported in a rotatable manner and a cleaning unit 5, which are arranged in this order on the basis of a rotation direction of the photosensitive drum 1. The development rotary 4 stores developers of four colors consisting of magenta, yellow, cyan and black.

A first transfer roller 7 is disposed between the development rotary 4 and the cleaning unit 5 in such a manner that it is pressed against the photosensitive drum 1 through the intermediate transfer belt 6. On the basis of a rotation direction of the intermediate transfer belt 6 (see the arrow S in FIG. 1), the first transfer roller 7, a driven roller 8, a drive roller 9 and a tension roller 10 are arranged in this order inside the intermediate transfer belt 6.

A second transfer roller 11 is disposed to come into contact with the drive roller 9 through the intermediate transfer belt 6. A sweeping system 12 is disposed in a region of the intermediate transfer belt 6 on a downstream side of the second transfer roller 11. A fixing section 16 is provided on a downstream side of the second transfer roller 11 in a sheet transport direction. A catch tray 17 is provided on a downstream side of the fixing section 16.

In this embodiment, an image forming unit is made up of the photosensitive drum 1, the charger 2, the laser scanning unit 3, the development rotary 4, the cleaning unit 5, the intermediate transfer belt 6, the first transfer roller 7, the driven roller 8, the drive roller 9, the tension roller 10, the second transfer roller 11 and the sweeping system 12.

Figure 2:
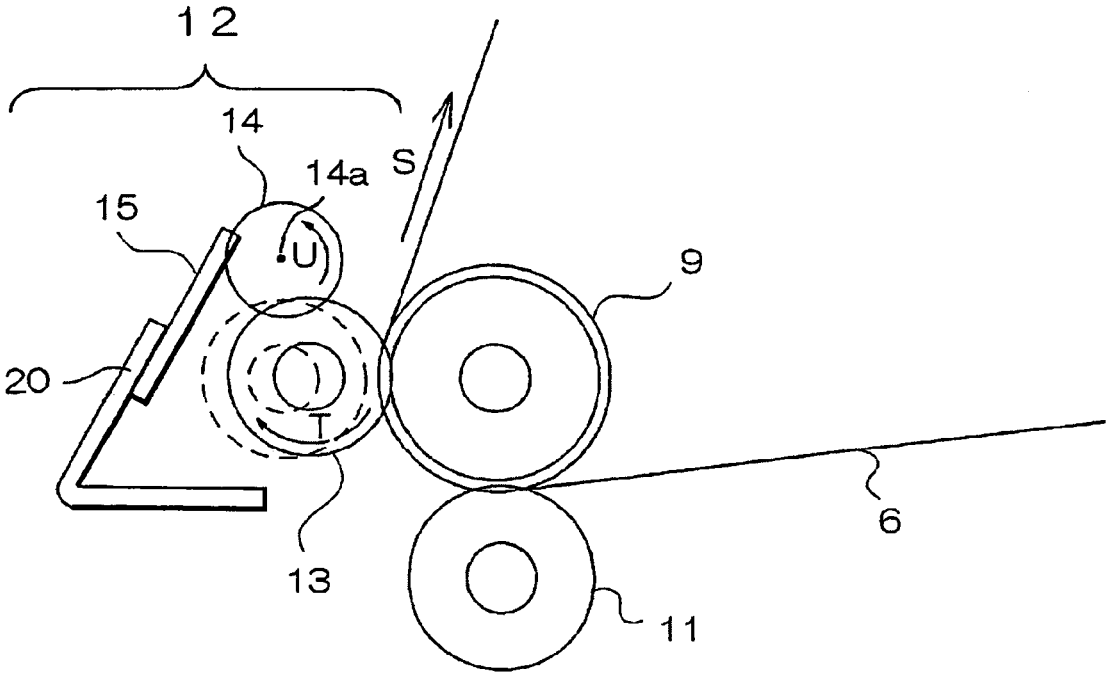
FIG. 2 is an enlarged view of the structure around a sweeping system of the image forming apparatus in FIG. 1.

The detail of the sweeping system 12 will be described below. FIG. 2 is an enlarged view of the structure around the sweeping system 12. This sweeping system 12 comprises a fur brush roller 13 which is pressed against the intermediate transfer belt 6, a recovery roller 14 which is pressed against the fur brush roller 13, and a blade 15 which is pressed against the recovery roller 14.

The fur brush roller 13 is supported by a bearing adapted to be swingable about a rotation axis of the recovery roller 14. That is, the fur brush roller 13 is adapted to be swingingly moved about a rotation shaft 14*a* of the recovery roller 14.

The fur brush roller 13 is associated with a drive mechanism (not shown) which comprises a spring for elastically pressing the fur brush roller 13 against the intermediate transfer belt 6, and a cam provided in a rotation shaft of the drive roller 9. The drive mechanism is operable to selectively press and move the fur brush roller 13 against/away from the intermediate transfer belt 6 serving as an image bearing member. Specifically, the fur brush roller 13 is constantly pressed against the intermediate transfer belt 6 by the spring, and, when needed, the cam is rotated to separate the fur brush roller 13 from the intermediate transfer belt 6. The fur brush roller 13 in a separated position is indicated by the dashed line in FIG. 2.

The bearing of the fur brush roller 13 is adapted to be swingable about a rotation axis of the recovery roller 14, as described above. Thus, a bite depth of the fur brush roller 13 to the recovery roller 14 (as described in detail later) is kept constant.

One of two bearings of the recovery roller 14 is made of an electrically conductive material, and a bias voltage is applied to the recovery roller 14 through this conductive bearing. In contract, the fur brush roller 13 has a bearing made of an electrically nonconductive material to allow the bias voltage applied to the recovery roller 14 to be used as a cleaning bias without any loss. In FIG. 2, the drive roller 9 has an electrical conductivity to serve as a cleaning counter electrode. A cleaning current flows from the recovery roller 14 to the drive roller 9 through the electrically-conductive fur brush roller 13 and the intermediate transfer belt 6. An electric field required between the intermediate transfer belt 6 and the fur brush roller 13 and between the fur brush roller 13 and the recovery roller 14 can be sufficiently formed by optimizing an electrical resistance of the fur brush roller 13.

The fur brush roller 13, the recovery roller 14 and the blade 15 will be more specifically described. Firstly, the recovery roller 14 will be described.

While various types of electrically conductive metal rollers may be used as the recovery roller 14, it is preferable to use a round bar made of stainless steel. The recovery roller 14 is formed to have a roller diameter of 10 mm or less, and a surface roughness Rz of 1.6 μm to 6.4 μm. As used in this specification, the "Rz" means a ten-point average roughness value defined by JIS B0601: 1994.

Generally, shafts are often plated through an electroless nickel plating process or the like. However, it is undesirable to plate the recovery roller 14, because a plated surface makes it difficult to control a surface roughness. Thus, in a process of preparing the recovery roller 14, a level of surface level may be controlled by subjecting a stainless-steel round bar to a cutting work, and then a blasting process according to need.

Secondly, the fur brush roller 13 as one example of a sweep roller of the present invention will be described. For example, the fur brush roller 13 is formed by: preparing a long woven cloth having brush fibers (filaments) made of a resin material, such as 6-nylon, and implanted therein in high density; spirally winding the woven cloth around the entire circumference of a stainless-steel shaft, and then bonding them together in a roll shape. In the fur brush roller 13, the shaft has a diameter of about 6 mm, and the woven cloth has a thickness of about 1 to 2 mm. Further, the brush fiber has a length of about 3 to 4 mm. Thus, the fur brush roller 13 has a diameter of about 14 mm. In this case, fluorine-based resin powder (e.g., Kynar 500®; available from Mitsubishi Chemical Corp.) may be applied to the brush fibers in advance as lubricant.

Preferably, the brush fiber of the fur brush roller 13 has a thickness of 1 to 6 deniers (denier is the unit of thickness of silk or chemical fiber, and a thickness of a silk or fiber having a length of 9000 m and a weight of 1 g is defined as 1 denier)

Preferably, a nylon fiber, such as 6-nylon or 12-nylon, a polyester fiber or an acrylic fiber is used as a material of the brush fiber. More preferably, carbon black is mixed with the material to impart electrical conductivity.

Figure 3:
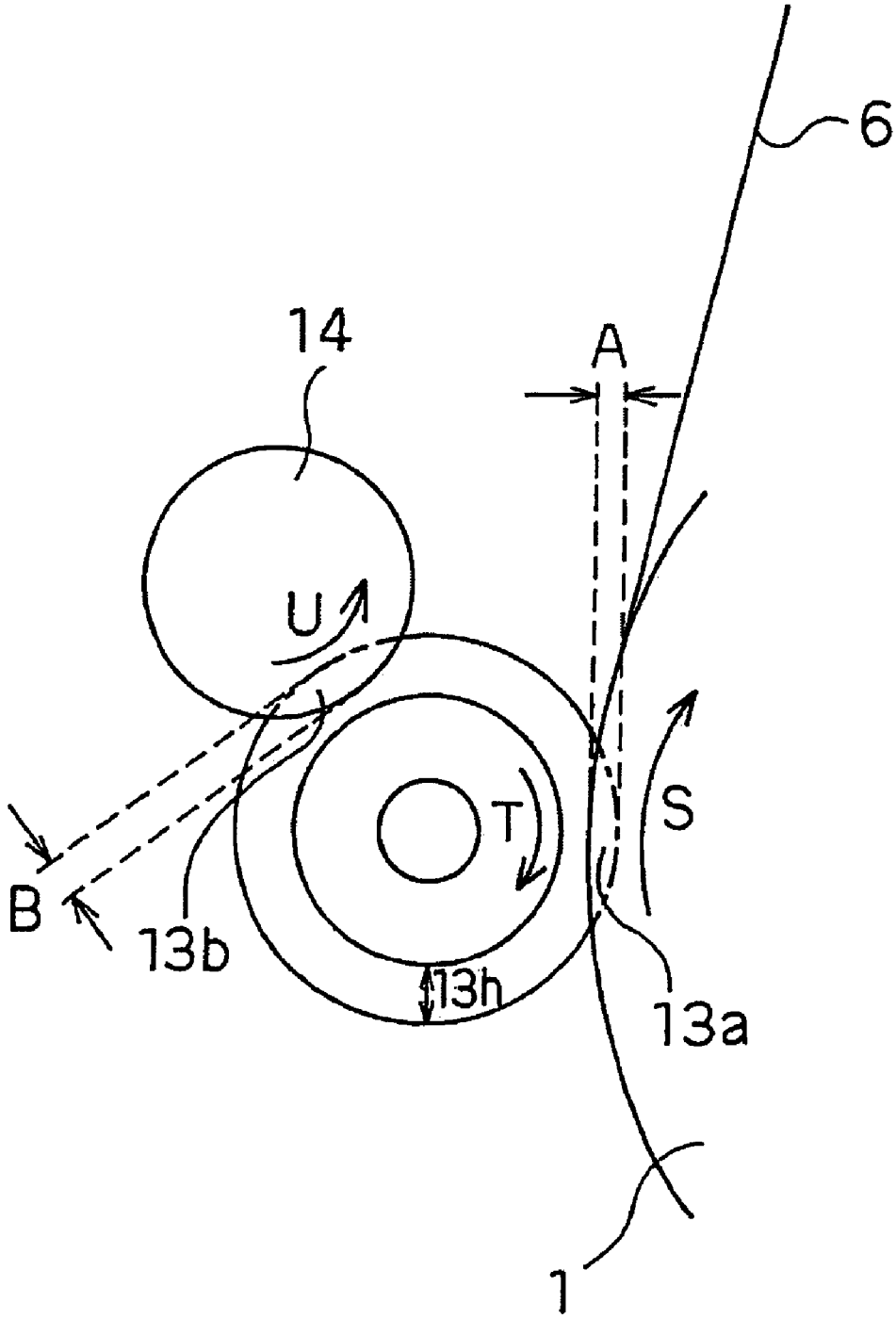
FIG. 3 is a schematic diagram showing a positional relationship of an intermediate belt, a fur brush roller and a recovery roller in the first embodiment.

FIG. 3 is an enlarged schematic diagram showing a region where the fur brush roller 13 is pressed against the intermediate transfer belt 6. As shown in FIG. 3, the fur brush roller 13 is in contact with the intermediate transfer belt 6 with a bite depth A. This "bite depth" is defined as a maximum value of a distance by which an outermost edge of a region of the brush fibers gets inside the intermediate transfer belt 6 under the assumption that the intermediate transfer belt 6 does not exist. The area indicated by the reference code 13*h* in FIG. 3 corresponds to the above brush fiber region.

In the first embodiment, the bite depth A is set at 1+0.2 mm. Alternatively, the bite depth A may be set at any value equal to or less than one half of a filament length of the brush fiber. Preferably, the bite depth A is set in the range of 0.5 to 1.5 mm.

In a contact zone 13*a* with the intermediate transfer belt 6, the fur brush roller 13 is rotated such that an outer peripheral surface thereof is moved in the arrow direction T opposite to the moving direction (arrow direction S) of an outer surface of the intermediate transfer belt 6. Further, in the contact zone 13*a*, a linear velocity ratio of the fur brush roller 13 to the intermediate transfer belt 6 is set at 1.1. This linear velocity ratio is preferably set in the range of 0.5 to 2.0, more preferably in the range of 0.8 to 1.20.

A positional relationship between the fur brush roller 13 and the recovery roller 14 will be described below. The fur brush roller 13 with untransferred toner particles and paper powder attached thereon is in contact with the recovery roller 14 with a bite depth B. In a contact zone 13*b* with the fur brush roller 13, the recovery roller 14 is rotated such that an outer peripheral surface thereof is moved in the arrow direction U identical to the moving direction of the outer surface of the fur brush roller 13, so as to allow toner particles attached on the brush fibers to be electrically recovered on the side of the recovery roller 14. This "bite depth" is defined as a maximum value of a distance by which the outermost edge of the brush fiber region gets inside the recovery roller 14 under the assumption that the recovery roller 14 does not exist. In the first embodiment, the bite depth B is set at 1.0±0.2 mm. Preferably, the bite depth B is set in the range of 0.5 to 1.5 mm.

Preferably, the bite depth A and the bite depth B are set to have a relationship of A≦B. The reason is that, if A>B, toner particles are more likely to be accumulated inside the brush fibers.

Thirdly, the blade 15 will be described. The blade 15 is made of a primary component consisting of polyurethane rubber, and an anchor end of the blade 15 is adhesively fixed to the plate 20 to allow a distal end thereof to be pressed against the recovery roller 14 with a given press-in depth (see FIG. 2).

Figure 4:
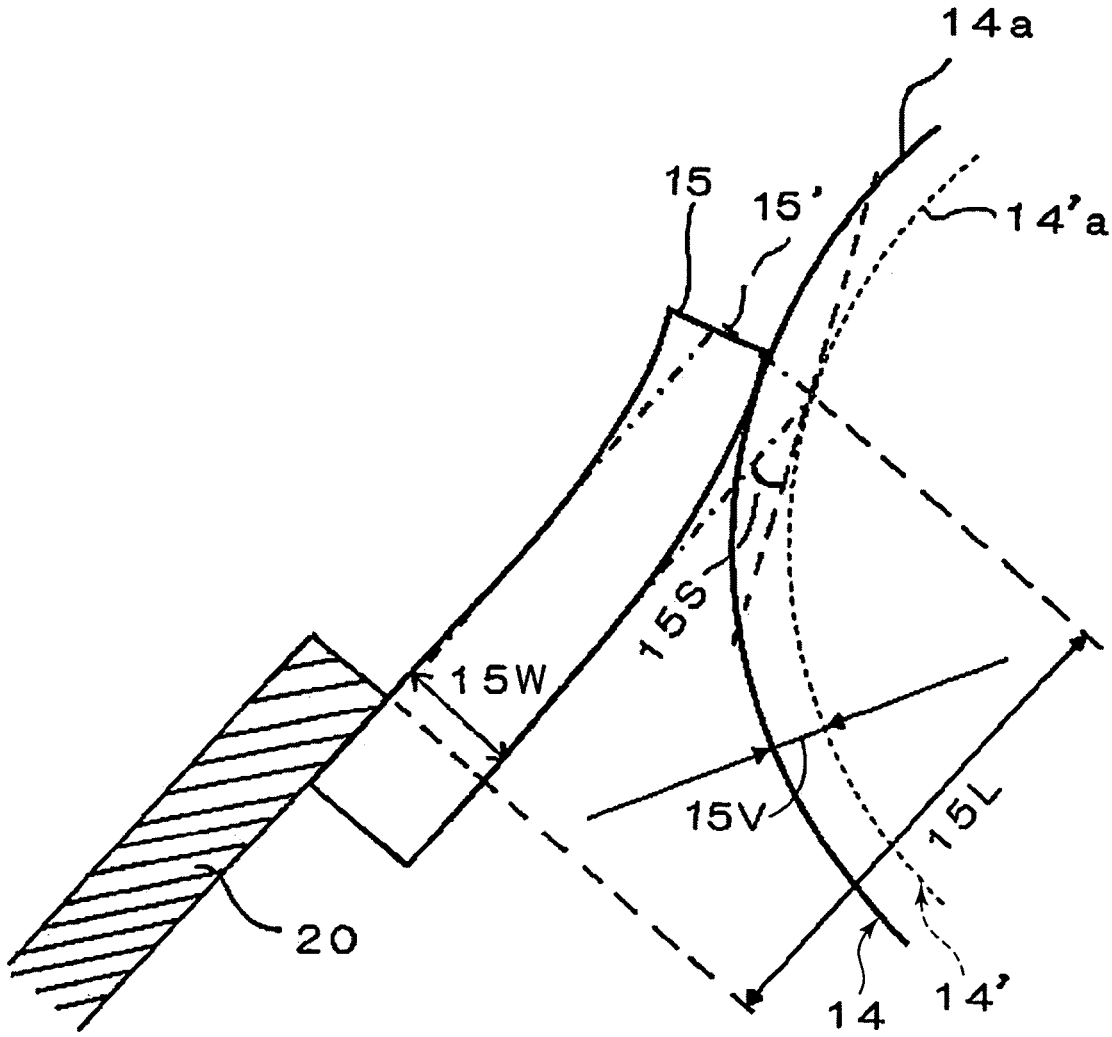
FIG. 4 is an explanatory schematic diagram of a press-in depth of a blade relative to the recovery roller in the first embodiment.

With reference to FIG. 4, the press-in depth of the blade will be described. Given that the blade is located in a position indicated by the reference code 15' if the recovery roller 14 does not exist, a virtual circle 14' in contact with the distal end of the blade 15' and concentric with the recovery roller 14 is determined. In this case, the "press-in depth" is defined as a distance 15V between an outer circumference 14*a* of the actual recovery roller 14 and an outer circumference 14'*a* of the virtual circle 14'. Preferably, in the first embodiment, the press-in depth is set in the range of 0.5 to 1.5 mm.

Now, toner particles used in the first embodiment will be described. The toner particles used in the first embodiment have a roundness of 0.97 or more, a volume-average particle diameter of 4 μm to 8 μm, and a variation coefficient of number distribution of 26% or less. Further, the toner particles have a charge amount of 30 μC/g or more when they are on the surface of the photosensitive drum 1. Preferably, the volume-average particle diameter of the toner particles is set at 7 μm or less. Further, the variation coefficient of number distribution is preferably set at 23% or less. The charge amount of the toner particles is preferably set at 35 μC/g or more, more preferably 40 μC/g or more. In this case, a pressing force of the blade 15 should be increased, because an adhesion force of the toner particle becomes higher as the charge amount is increased.

The toner particles having a roundness of 0.97 or more and a volume-average particle diameter of 4 μm to 8 μm can be used in a full-color image forming apparatus to facilitate enhancement in image quality. Further, the toner particles having the variation coefficient of 26% or less can suppress variation in toner charge. The above toner particles having a small volume-average particle diameter and a variation coefficient of 26% or less have enhanced transfer efficiency. Thus, the use of such toner particles leads to a lower amount of toner particles to be recovered by the sweeping system, which is likely to cause a problem about the "blade noise" during a sweeping operation.

Further, the recovery roller 14 is designed to electrically recover toner particles, and thereby an adhesion force between the recovery roller 14 and the toner particles will become higher as the toner particles have a smaller volume-average particle diameter, or a higher charge amount. This causes difficulty in sweeping the toner particles by the blade 15. Even in such toner particles, the recovery roller having a surface roughness Rz of 1.6 μm to 6.4 μm allows the sweeping operation to be adequately performs without occurrence of the "blade noise".

The operation of the printer illustrated in FIG. 1 will be described below. The charger 2 electrostatically charges a surface of the photosensitive drum 1, and then the laser scanning unit 3 forms an electrostatic latent image on the charged surface of the photosensitive drum 1. Then, one of the four colors of developers stored in the development rotary 4 is selected, and a toner image is formed using the selected developer in accordance with the electrostatic latent image.

The toner image is transferred onto the intermediate transfer belt 6 by the first transfer roller 7. Subsequently, in the same manner, respective toner images of the remaining colors will be formed on the intermediate transfer belt 6. During the process of forming the toner images of the four colors on the intermediate transfer belt 6, the fur brush roller 13 is separated away (i.e., spaced apart) from the intermediate transfer belt 6.

Then, the four-color superimposed toner images on the intermediate transfer belt 6 are collectively transferred onto a recording medium, such as a paper or a sheet, by the second transfer roller 11. The sheet with the transferred toner image is transported to the fixing section 16, and, after completion of fixing of the toner image, ejected and placed to/on the catch tray 17.

In the process of transferring the toner images onto the recording medium by the second transfer roller 11, the fur brush roller 13 is pressed against the intermediate transfer belt 6 to remove toner particles which have not been transferred to the recording medium, from a surface of the intermediate transfer belt 6.

Then, the toner particles on the brush fibers of the fur brush roller 13 are recovered by the recovery roller 14. Further, the toner particles on the recovery roller 14 are scraped off by the blade 15. The toner particles scraped off by the blade 15 are sequentially sent to a waste-toner container by a toner transport screw (not shown).

Based on the following Examples, the first embodiment will be more specifically described. The following evaluations on Inventive and Comparative Examples were performed using the color printer and the sweeping system illustrated in FIGS. 1 and 2.

Figures 5A, 5B:
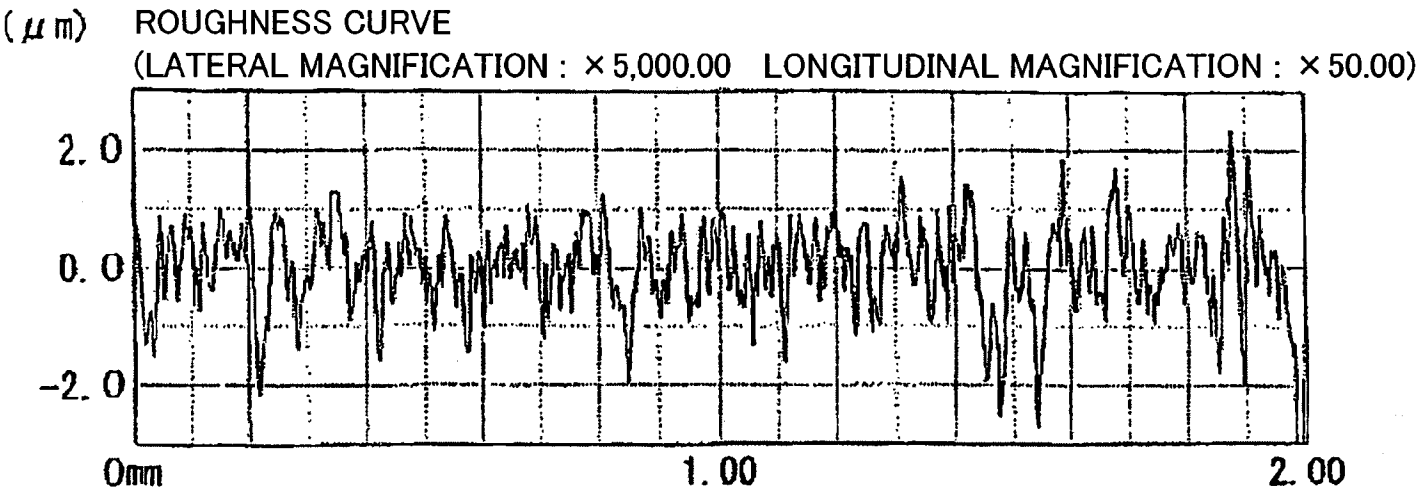
FIG. 5A is a table showing a condition for measuring a surface-roughness of a recovery roller.
FIG. 5B is a graph showing one example of a surface-roughness curve of a recovery roller.

(Inventive Example 1) A recovery roller 14 used in Inventive Example 1 was a stainless-steel round bar having a diameter of 10 mm, a surface roughness (Rz) of 1.6 μm. The surface roughness (Rz) of the recovery roller 14 was measured using Surfcom 1500 DX (produced by Tokyo Seimitsu Co., Ltd.) under the following conditions: measurement type=JIS B0601: 1994; measurement length =4 mm; measurement pressure=0.7 mN; measurement velocity=0.15 mm/sec; cut off=Gaussian; edge of contact stylus=2 μm; and measurement direction=axial direction. FIGS. 5A and 5B show one example of a roughness curve obtained in the measurement. The graph illustrated in FIGS. 5A and 5B show a measurement result on a sample having a surface roughness of 3.3 μm.

A fur brush roller 13 had brush fibers formed of 6-nylon (electrically conductive fibers). The fur brush roller 13 had a diameter of 14 mm, and the bush fibers had a filament density of 37200 filaments/$cm^2$ and a filament thickness of 2 denier.

A blade 15 was made of a primary component consisting of polyurethane rubber to have a thickness 15 W (see FIG. 4) of 1.6 ±0.15 mm and a hardness degree of 77±3. The blade 15 and the recovery roller 14 were positioned to have a rubber protruding length 15 L of 7.5 mm, a press-contact angle 15S of 22 degrees, and a press-in depth 15V of 1.0 mm (see FIG. 4). The rubber protruding length means a distance between an edge of the plate 20 and the distal end of the rubber blade 15', i.e., a free length of the rubber blade 15.

A developer used in Inventive Example 1 was prepared as follows.

Three colors of spherical-shaped toner particles were prepared by the following process. Firstly, 2 weight parts of polymerization initiator and 2 weight parts of azobis (2,4-dimethylvaleronitrile) were added to a mixed solution of 80 weight parts of styrene, 20 weight parts of 2-ethylhexyl methacrylate, 5 weight parts of colorant, 3 weight parts of low-molecular-weight polypropylene, 2 weight parts of charge control agent (quaternary ammonium salt) and 1 weight part of divinylbenzene (cross-linking agent). The obtained mixture was added to 400 weight parts of purified water, and then 5 weight parts of tricalcium phosphate and 0.1 weight parts of sodium dodecylbenzenesulfonate were added thereto as a suspension stabilizer. Then, the obtained mixture was stirred for 20 minutes at a speed of 7000 rpm using an emulsion/dispersion machine (produced by IPROS Corp.). Then, a polymerization reaction was induced in the stirred mixture under a nitrogen atmosphere at a temperature of 70° C. at a stirring speed of 100 rpm for 10 hours to obtain spherical-shaped toner particles (toner mother particles). According to a measurement result using a flow particle image analyzer FPIA (produced by Sysmex Corp.), the prepared spherical-shaped toner particles has an average roundness of 0.980.

Specifically, the measurement of roundness using the flow particle image analyzer FPIA (produced by Sysmex Corp.) was performed as follows.

As a dispersant, 0.1 to 0.5 ml of surfactant, preferably, alkyl benzene sulfonate, was added to 100 to 150 ml of water after removing impure solid matters therefrom. Then, 0.1 to 0.5 g of toner particles as a measurement sample were added to the obtained mixture. The obtained suspension containing the measurement sample dispersed therein was subjected to a dispersion treatment for 1 to 3 minutes to adjust a dispersed-phase concentration to 3000 to 10000 particles/μl. Then, the treated sample was subjected to the analyzer to measure roundness.

1.0 weight part of hydrophobic silica (trade name "TG820F" produced by Cabot Corp.) and 0.4 weight parts of titanium oxide (trade name "TAF-510P" produced by Fuji Titanium Industry Co., Ltd.) were mixed with 100 weight parts of each of the obtained toner mother particles, and the obtained mixture was kneaded for 2 minutes using a Henschel mixer to obtain a color developer.

A black developer was prepared by the following process. Firstly, plural types of polyester resins used as a binder resin were mixed with a magnetic powder and others, and then the obtained mixture was molted and kneaded. Specifically, 100 weight parts of polyester resins (alcohol component: bisphenol-A propionoxide addition; acid component: terephthalic acid; Tg: 60° C.; softening point: 150° C.; acid number: 7.0; gel fraction: 30%), 76 weight parts of magnetic powder (trade name "MTSB-905 " produced by Toda Kogyo Corp.), 3 weight parts of CCA (trade name "BONTRON No. 1" produced by Orient Chemical Industries, Ltd.) as a charge control agent, 8 weight parts of charge control resin (quaternary ammonium salt-added styrene-acrylic copolymer; FCA196 produced by Fujikura Kasei Co., Ltd.) and 3 weight parts of ester wax (trade name "WEP 5 " produced by NOF Corp.) as a wax component were mixed together and kneaded using a Henschel mixer.

Then, the mixture was further kneaded using a biaxial extruder (cylinder setup temperature: 100° C.), and then roughly crushed. Then, the roughly-crushed powder was finely crushed using a turbo-mill, and sorted using a flow classifier to obtain toner particles having a volume-average particle diameter of 8.0 μm and an average roundness of 0.95.

0.8 weight part of silica particles (trade name "RA200HS" produced by Japan Aerosil Co.) and 1.0 weight part of titanium oxide (trade name "EC100T1" produced by Titan Kogyo K.K.) were mixed with 100 weight parts of the obtained toner mother particles, and the obtained mixture was kneaded using a Henschel mixer to obtain an magnetic developer.

According to a measurement result using a QM meter (produced by Trec. Inc.), each of the color developer had a charge amount of 45 μC/g on the photosensitive drum. The black developer had a charge amount of 12 μC/g on the photosensitive drum. Further, each of the color and block developers had a number-variation coefficient of 25% or less.

Based on the above recovery roller 14 and blade 15, blade noise and wear of the blade 15 were evaluated.

In the evaluation on the blade noise of the blade 15, a sample generating the "blade noise" was evaluated as "x", and a sample generating no "blade noise" was evaluated as "○".

In the evaluation on wear of the blade 15, a length of a shaved portion at the edge of the blade 15 after $200\times10^3$ times of continuous printing operations (in Examples, $50\times10^3$ times of printing operations per color for color printing) was evaluated as "wear amount".

The recovery roller 14 and the fur brush roller 13 were rotated, respectively, at 420 rpm and 274 rpm.

Figure 6A:
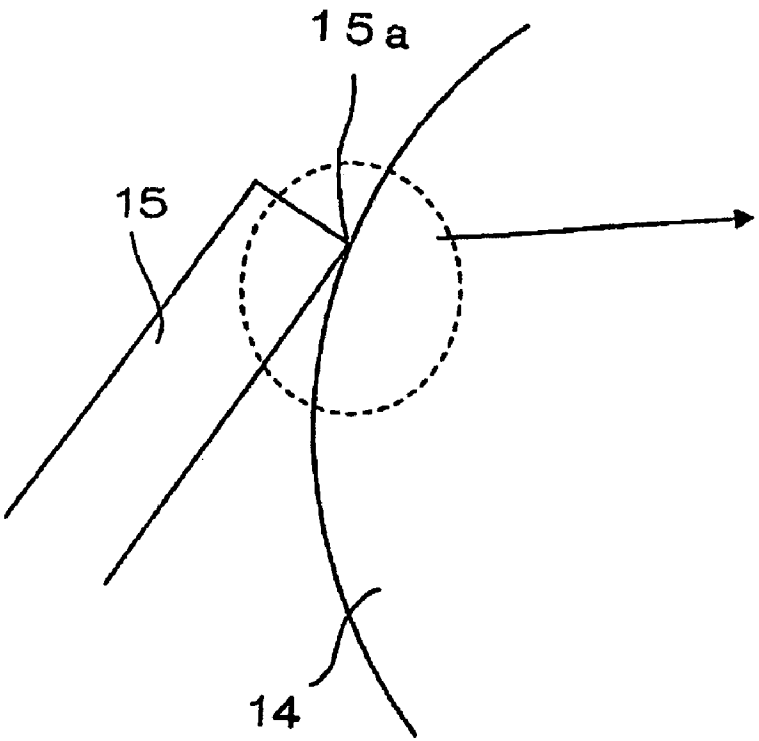
FIGS. 6A to 6C are explanatory schematic diagrams illustrating a wear amount of a blade.
Figure 6B:
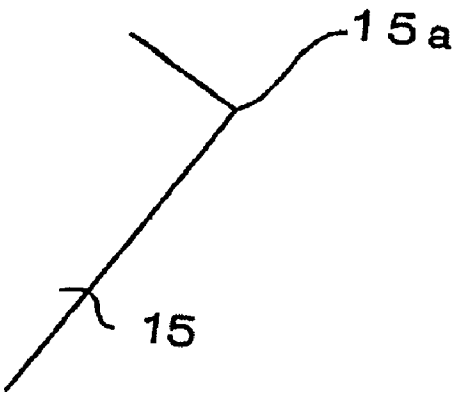
Figure 6C:
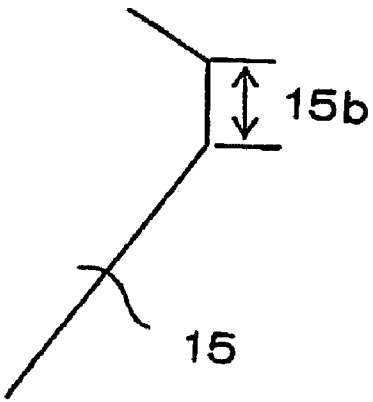

FIG. 6A is an enlarged view of the contact region between the blade 15 and the recovery roller 14. FIG. 6B shows an edge 15*a* of the blade 15 before the recovery roller 14 is rotated. FIG. 6C shows a worn state of the edge 15*a* of the blade 15 as the result of rotations of the recovery roller 14. A length 15*b* of the shaved portion in the edge 15*a* is the wear amount.

In this wear-amount measurement, a 3-dimensional shape measuring apparatus (WYKO NT1100 produced by Veeco Instruments, Inc) was used to perform a shape measurement, and a sample having a wear amount of less than 15 μm, and a sample having a different wear amount therefrom were evaluated, respectively, as "○" and "x".

Inventive Example 2) As Inventive Example 2, the "blade noise" and "wear amount" were evaluated using a sweeping system prepared by replacing the recovery roller in Inventive Example 1 with a recovery roller having a surface roughness Rz of 3.2 μm.

Inventive Example 3) As Inventive Example 3, the "blade noise" and "wear amount" were evaluated using a sweeping system prepared by replacing the recovery roller in Inventive Example 1 with a recovery roller having a surface roughness Rz of 6.4 μm.

Inventive Example 4) As Inventive Example 4, the "blade noise" and "wear amount" were evaluated using a sweeping system prepared by replacing the recovery roller in Inventive Example 1 with a recovery roller having a diameter of 9 mm.

Inventive Example 5) As Inventive Example 5, the "blade noise" and "wear amount" were evaluated using a sweeping system prepared by replacing the recovery roller in Inventive Example 2 with a recovery roller having a diameter of 9 mm.

(Inventive Example 6) As Inventive Example 6, the "blade noise" and "wear amount" were evaluated using a sweeping system prepared by replacing the recovery roller in Inventive Example 3 with a recovery roller having a diameter of 9 mm.

(Inventive Example 7) As Inventive Example 7, the "blade noise" and "wear amount" were evaluated using a sweeping system prepared by replacing the recovery roller in Inventive Example 1 with a recovery roller having a diameter of 8 mm.

(Inventive Example 8) As Inventive Example 8, the "blade noise" and "wear amount" were evaluated using a sweeping system prepared by replacing the recovery roller in Inventive Example 2 with a recovery roller having a diameter of 8 mm.

(Inventive Example 9) As Inventive Example 9, the "blade noise" and "wear amount" were evaluated using a sweeping system prepared by replacing the recovery roller in Inventive Example 3 with a recovery roller having a diameter of 8 mm.

(Inventive Example 10) As Inventive Example 10, the "blade noise" and "wear amount" were evaluated using a sweeping system prepared by replacing the recovery roller in Inventive Example 1 with a recovery roller having a diameter of 7 mm.

(Inventive Example 11) As Inventive Example 11, the "blade noise" and "wear amount" were evaluated using a sweeping system prepared by replacing the recovery roller in Inventive Example 2 with a recovery roller having a diameter of 7 mm.

(Inventive Example 12) As Inventive Example 12, the "blade noise" and "wear amount" were evaluated using a sweeping system prepared by replacing the recovery roller in Inventive Example 3 with a recovery roller having a diameter of 7 mm.

Comparative Example 1) As Comparative Example 1, the "blade noise" and "wear amount" were evaluated using a sweeping system prepared by replacing the recovery roller in Inventive Example 1 with a recovery roller having a surface roughness Rz of 1.2 μm.

Comparative Example 2) As Comparative Example 2, the "blade noise" and "wear amount" were evaluated using a sweeping system prepared by replacing the recovery roller in Inventive Example 1 with a recovery roller having a surface roughness Rz of 6.6 μm.

Comparative Example 3) As Comparative Example 3, the "blade noise" and "wear amount" were evaluated using a sweeping system prepared by replacing the recovery roller in Inventive Example 4 with a recovery roller having a surface roughness Rz of 1.2 μm.

(Comparative Example 4) As Comparative Example 4, the "blade noise" and "wear amount" were evaluated using a sweeping system prepared by replacing the recovery roller in Inventive Example 4 with a recovery roller having a surface roughness Rz of 6.6 μm.

(Comparative Example 5) As Comparative Example 5, the "blade noise" and "wear amount" were evaluated using a sweeping system prepared by replacing the recovery roller in Inventive Example 7 with a recovery roller having a surface roughness Rz of 1.2 μm.

(Comparative Example 6) As Comparative Example 6, the "blade noise" and "wear amount" were evaluated using a sweeping system prepared by replacing the recovery roller in Inventive Example 7 with a recovery roller having a surface roughness Rz of 6.6 μm.

(Comparative Example 7) As Comparative Example 7, the "blade noise" and "wear amount" were evaluated using a sweeping system prepared by replacing the recovery roller in Inventive Example 10 with a recovery roller having a surface roughness Rz of 1.2 μm.

(Comparative Example 8) As Comparative Example 8, the "blade noise" and "wear amount" were evaluated using a sweeping system prepared by replacing the recovery roller in Inventive Example 10 with a recovery roller having a surface roughness Rz of 6.6 μm.

The results of Inventive Examples 1 to 12 and Comparative Examples 1 to 8 are shown in Table 1.

TABLE 1

| | RECOVERY ROLLER | | | | FUR BRUSH ROLLER | |
|---|---|---|---|---|---|---|
| | | SURFACE | | | | |
| | DIAMETER (mm) | ROUGHNESS (μm) | SPEED (rpm) | BLADE PRESS (mm) | DIAMETER (mm) | SPEED (rpm) |
| COMPARATIVE EXAMPLE 1 | 10 | 1.2 | 420 | 1 | 14 | 274 |
| EXAMPLE 1 | 10 | 1.6 | 420 | 1 | 14 | 274 |
| EXAMPLE 2 | 10 | 3.2 | 420 | 1 | 14 | 274 |
| EXAMPLE 3 | 10 | 6.4 | 420 | 1 | 14 | 274 |
| COMPARATIVE EXAMPLE 2 | 10 | 6.6 | 420 | 1 | 14 | 274 |

TABLE 1-continued

| | | | | | | |
|---|---|---|---|---|---|---|
| COMPARATIVE EXAMPLE 3 | 9 | 1.2 | 420 | 1.1 | 14 | 274 |
| EXAMPLE 4 | 9 | 1.6 | 420 | 1.1 | 14 | 274 |
| EXAMPLE 5 | 9 | 3.2 | 420 | 1.1 | 14 | 274 |
| EXAMPLE 6 | 9 | 6.4 | 420 | 1.1 | 14 | 274 |
| COMPARATIVE EXAMPLE 4 | 9 | 6.6 | 420 | 1.1 | 14 | 274 |
| COMPARATIVE EXAMPLE 5 | 8 | 1.2 | 420 | 1.2 | 14 | 274 |
| EXAMPLE 7 | 8 | 1.6 | 420 | 1.2 | 14 | 274 |
| EXAMPLE 8 | 8 | 3.2 | 420 | 1.2 | 14 | 274 |
| EXAMPLE 9 | 8 | 6.4 | 420 | 1.2 | 14 | 274 |
| COMPARATIVE EXAMPLE 6 | 8 | 6.6 | 420 | 1.2 | 14 | 274 |
| COMPARATIVE EXAMPLE 7 | 7 | 1.2 | 420 | 1.3 | 14 | 274 |
| EXAMPLE 10 | 7 | 1.6 | 420 | 1.3 | 14 | 274 |
| EXAMPLE 11 | 7 | 3.2 | 420 | 1.3 | 14 | 274 |
| EXAMPLE 12 | 7 | 6.4 | 420 | 1.3 | 14 | 274 |
| COMPARATIVE EXAMPLE 8 | 7 | 6.6 | 420 | 1.3 | 14 | 274 |

| | RECOVERY/ FUR BLUSH LINEAR VELOCITY RATIO | WEAR AMOUNT (END REGION) (μm) | WEAR AMOUNT (CENTRAL REGION) (μm) | EVALUATION OF BLADE NOISE | EVALUATION OF WEAR AMOUNT |
|---|---|---|---|---|---|
| COMPARATIVE EXAMPLE 1 | 1.09 | 4 | 3 | X | X |
| EXAMPLE 1 | 1.09 | 5 | 4 | ○ | ○ |
| EXAMPLE 2 | 1.09 | 7 | 6 | ○ | ○ |
| EXAMPLE 3 | 1.09 | 12 | 8 | ○ | ○ |
| COMPARATIVE EXAMPLE 2 | 1.09 | 15 | 10 | ○ | X |
| COMPARATIVE EXAMPLE 3 | 0.99 | 5 | 3 | X | X |
| EXAMPLE 4 | 0.99 | 6 | 4 | ○ | ○ |
| EXAMPLE 5 | 0.99 | 8 | 6 | ○ | ○ |
| EXAMPLE 6 | 0.99 | 13 | 8 | ○ | ○ |
| COMPARATIVE EXAMPLE 4 | 0.99 | 17 | 10 | ○ | X |
| COMPARATIVE EXAMPLE 5 | 0.88 | 7 | 3 | X | X |
| EXAMPLE 7 | 0.88 | 8 | 4 | ○ | ○ |
| EXAMPLE 8 | 0.88 | 9 | 6 | ○ | ○ |
| EXAMPLE 9 | 0.88 | 14 | 8 | ○ | ○ |
| COMPARATIVE EXAMPLE 6 | 0.88 | 20 | 10 | ○ | X |
| COMPARATIVE EXAMPLE 7 | 0.77 | 9 | 3 | X | X |
| EXAMPLE 10 | 0.77 | 12 | 4 | ○ | ○ |
| EXAMPLE 11 | 0.77 | 10 | 6 | ○ | ○ |
| EXAMPLE 12 | 0.77 | 14 | 8 | ○ | ○ |
| COMPARATIVE EXAMPLE 8 | 0.77 | 24 | 10 | ○ | X |

As seen in the results of Table 1, when the recovery roller has a diameter of 10 mm or less, and a surface roughness Rz of 1.6 μm to 6.4 μm, the blade 15 generates no "blade noise", and the blade wear amount is reduced.

Further, as seen in the results of Table 1, when the recovery roller has a diameter of 10 mm or less, and a surface roughness Rz of less than 1.6 μm, the blade noise and the blade wear amount become prominent due to increased adhesion force between respective surfaces of the recovery roller 14 and the blade 15.

It is also proven that, when the recovery roller has a diameter of 10 mm or less, and a surface roughness Rz of greater than 6.4 μm, the blade wear amount become larger to cause significant deterioration in durability, even through no blade noise is generated.

When the recovery roller 14 is reduced in size as in the first embodiment, it is required to position the recovery roller 14 and the blade with a high degree of accuracy. If the position of the recovery roller 14 is moved in conjunction with the separation of the fur brush roller 13 from the intermediate transfer belt 6, a relative position between the recovery roller 14 and the blade 15 is likely to be undesirably changed to cause occurrence of the blade noise and acceleration of the blade wear.

In the first embodiment, only the fur brush roller 13 can be swingingly moved about the axis 14*a* in such as manner as to be separated away from the intermediate transfer belt 6, while allowing respective positions of the recovery roller 14 and the blade 15 to be fixed, so as to minimize the displacement between the recovery roller 14 and the blade 15.

A recovery roller according to a second embodiment of the present invention will be described below. The recovery roller according to the second embodiment is further improved in surface profile as compared with the recovery roller according to the first embodiment.

The recovery roller 14 according to the second embodiment has a diameter of 10 mm or less, a surface roughness Rz of 1.6 μm to 6.4 μm, and a load length rate (tp) of 70% or more when a cutting level is 30% in a load curve obtained by a measurement of the surface roughness.

Figure 7:
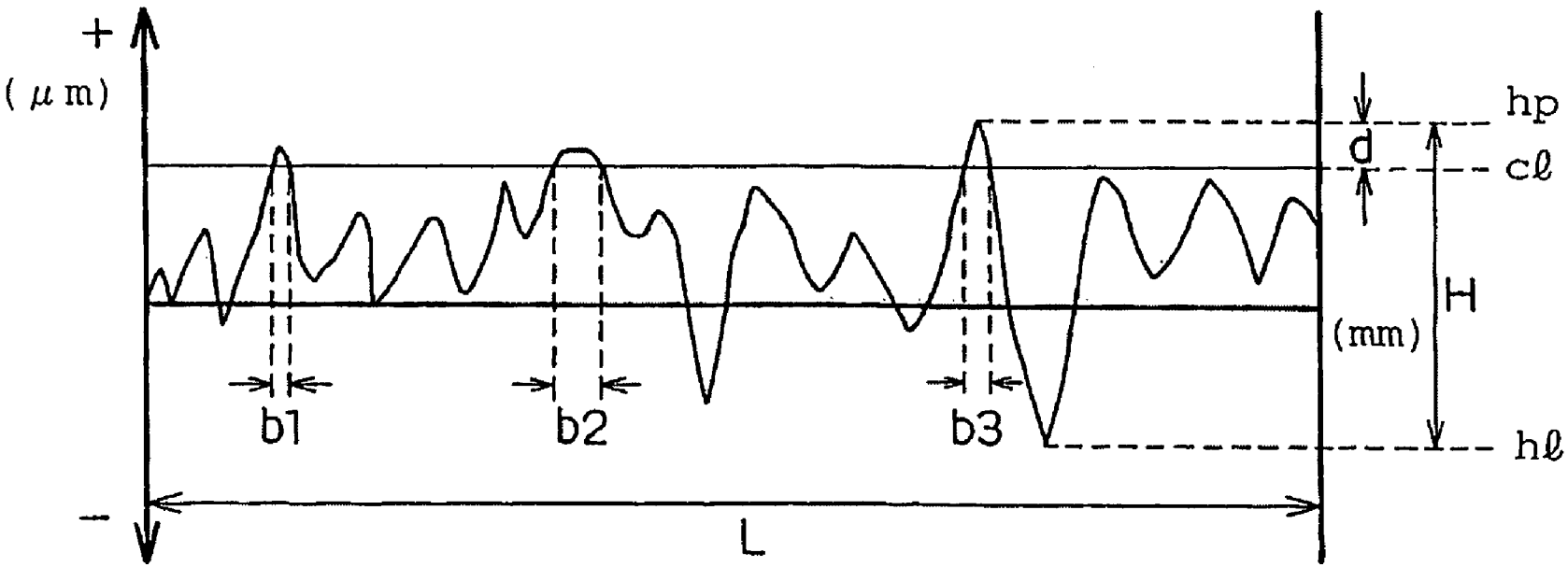
FIG. 7 is an explanatory schematic diagram of a load length rate in a surface profile of a recovery roller according to a second embodiment of the present invention.

The load length rate (tp) is determined as follows. As shown in FIG. 7, apart of the roughness curve is cut out by a reference length L in a direction of an average line thereof. Then, the cut-out partial roughness curve is cut by a cutting level cl parallel to an average line, and respective lengths of the resulting sections are summed to obtain a load length ηP (=b1+b2+b3). Then, a ratio of the load length ηP to the reference length L is expressed by percentage. That is, the load length rate (tp)=(ηP/L)×100.

The cutting level is a ratio of "a length d between the highest position hp and the cutting level cl" to "a difference H between the highest position hp and the lowest position h1" in the partial roughness curve, which is expressed by percentage (see FIG. 7).

Figure 8:
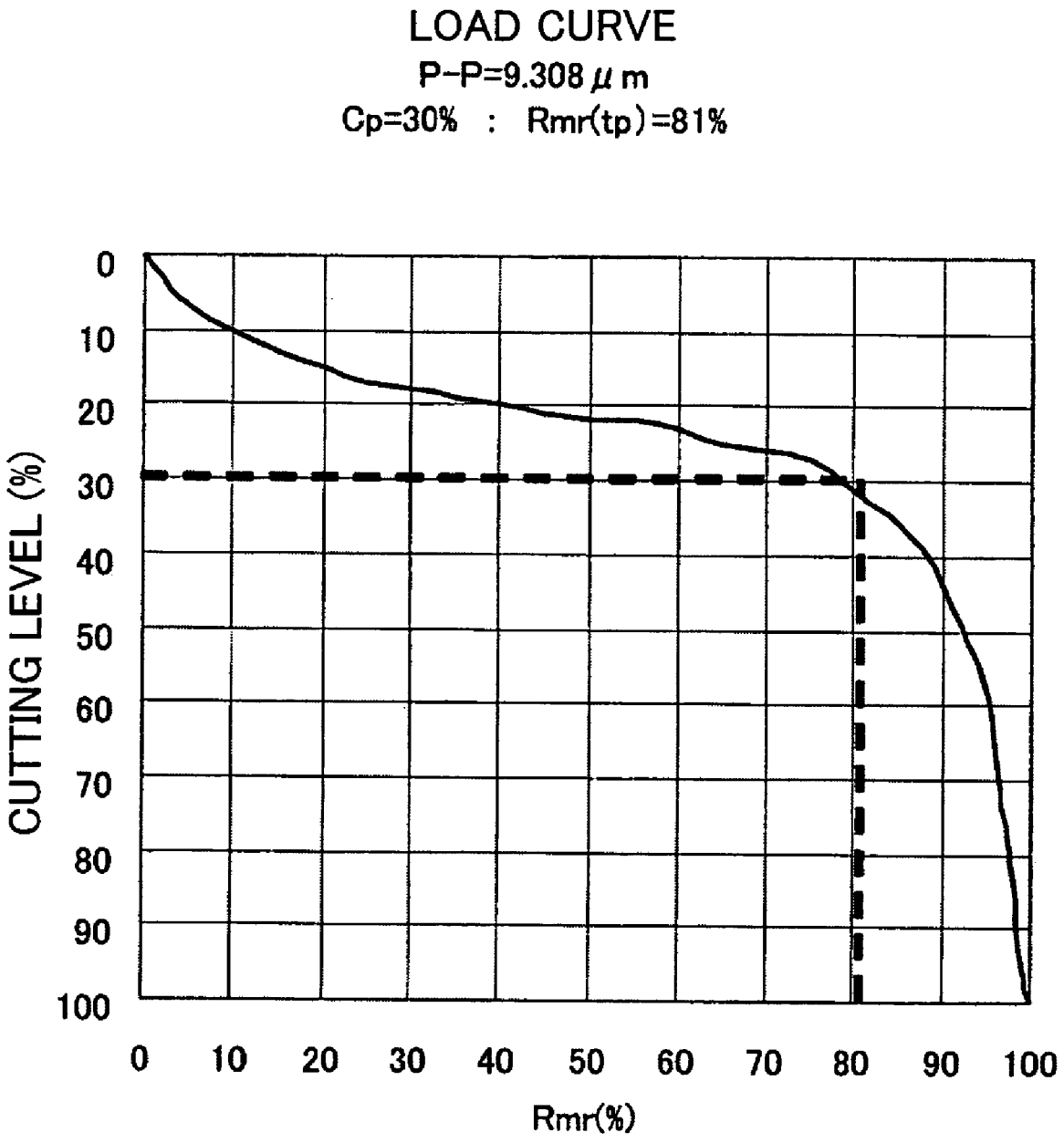
FIG. 8 is a graph showing one example of a load curve in the surface profile of the recovery roller according to the second embodiment.
Figure 9:
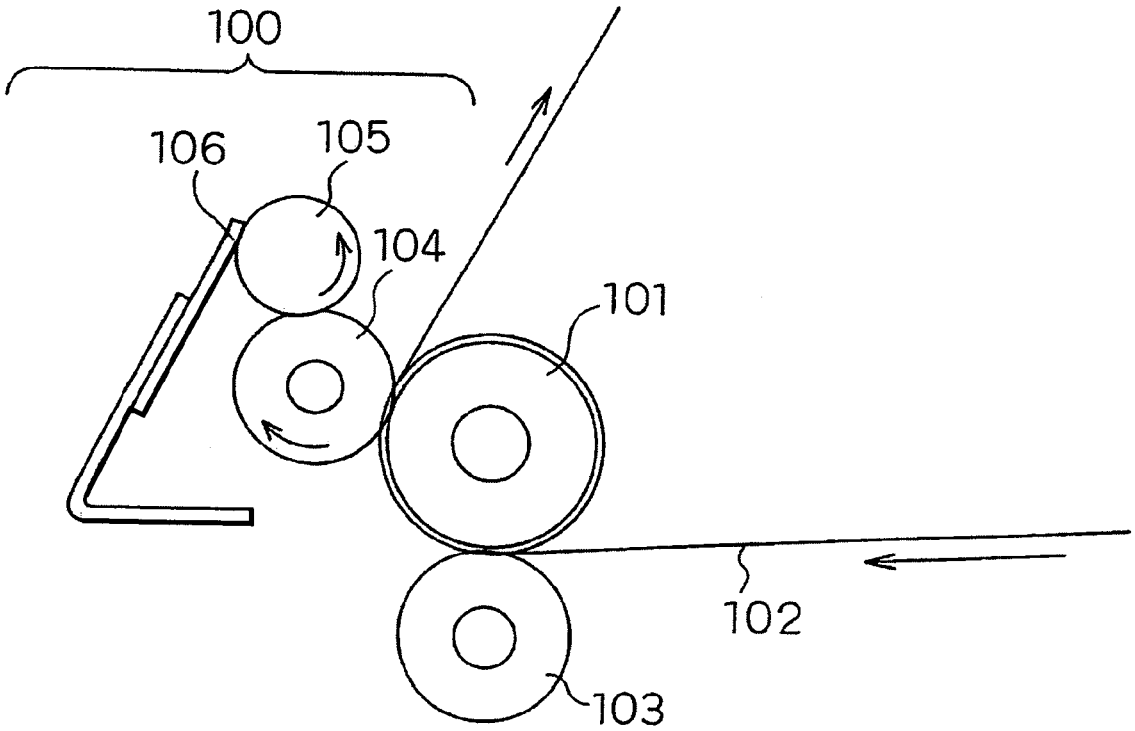
PRIOR ART FIG.9
FIG. 9 is a schematic diagram showing the structure of a conventional sweeping system.

As one example, FIG. 8 shows a load curve where the load length rate (tp) is 81% when the cutting level is 30%. As shown in FIG. 8, the load curve is a graph which has a horizontal axis representing a load length rate (Rmr), and a vertical axis representing the cutting level. In the graph of FIG. 8, P-P indicates the difference between the highest position hp and the lowest position h1 in the surface-roughness curve (see FIG. 7).

A mechanism of allowing toner to be moved from the fur brush roller 13 to the recovery roller 14 is fundamentally that an electric field is formed between the recovery roller 14 and the fur brush roller 13, and toner particles as charged particles are moved to the recovery roller 14 according to an electrical attraction force. However, if a surface of the recovery roller 14 a profile inadequate for transporting toner particles, toner particles electrically peeled from the fur blush roller 13 in a course of being moved from the fur brush roller 13 to the recovery roller 14 are more likely to be flicked by the surface of the recovery roller 14 and scattered.

In this regard, the recovery roller 14 according to the second embodiment has the feature about the surface profile that a load length rate is 70% or more when a cutting level is 30%, in addition to the features in the first embodiment. This makes it possible to suppress the toner scattering which otherwise occurs during recovery of toner particles.

The recovery roller 14 according to the second embodiment will be more specifically described based on Inventive Examples thereof and Comparative Examples. As to a component or element which is not included in the following description about Inventive Examples and Comparative Examples, the same component or element as that of the printer and sweeping system in the first embodiment was used to perform evaluations.

(Inventive Example 13) A recovery roller 14 used in Inventive Example 13 was made of stainless steel, and formed to have a diameter of 10 mm, a surface roughness Rz of 1.6 μm, and a load length rate of 88% in a cutting level of 30% (wherein the reference length=4.0 mm; this is applied to other Inventive Examples and Comparative Example). This recovery roller 14 was prepared by subjecting the stainless-steel round bar to a cutting work and then subjecting the bar to grinding using a sandpaper, and buffing. The surface roughness (Rz) was measured in the same manner as that in Inventive Example 1. A fur brush roller 13 had brush fibers formed of 6-nylon (electrically conductive fibers). The fur brush roller 13 had a diameter of 14 mm, and the bush fibers had a filament density of 37200 filaments/$cm^2$ and a filament thickness of 2 denier.

A blade 15 was made of a primary component consisting of polyurethane rubber to have a thickness 15W of 1.6±0.15 mm and a hardness degree of 77±3. The blade 15 and the recovery roller 14 were positioned to have a rubber protruding length of 7.5 mm, a press-contact angle 15S of 22 degrees, and a press-in depth of 1.0 mm.

The recovery roller 14 was driven under the above conditions, and the "scattering" of toner particles, the "blade noise" and "wear amount" of the blade 15 were evaluated.

In the evaluation on the "scattering" of toner particles, toner particles attached on the intermediate transfer belt 6 after scattered were taken by a transparent adhesive tape, and the adhesive tape was attached on a while paper. Then, a transmission density was measured using a Model 310T (photographic densitometer; produced by X-Rite Inc.). A sample having a transmission density of less than 0.06 and a sample having a transmission density of 0.06 or more were evaluated, respectively, as "○" and "x".

The evaluations on the blade noise, and the blade wear were performed in the same manner as those in Inventive Example 1.

(Inventive Example 14) As Inventive Example 14, the "scattering" of toner particles, the "blade noise" and "blade wear amount" were evaluated using a sweeping system prepared by replacing the recovery roller in Inventive Example 13 with a recovery roller having a surface roughness Rz of 3.6 μm, and a load length rate of 86% in a cutting level of 30%. The recovery roller used in Inventive Example 14 was prepared by subjecting an aluminum round bar to a cutting work and then subjecting the bar to grinding using a sandpaper, and buffing.

(Inventive Example 15) As Inventive Example 15, the "scattering" of toner particles, the "blade noise" and "blade wear amount" were evaluated using a sweeping system prepared by replacing the recovery roller in Inventive Example 13 with a recovery roller having a surface roughness Rz of 5.2 μm, and a load length rate of 75% in a cutting level of 30%. The recovery roller used in Inventive Example 15 was prepared by subjecting an aluminum round bar to a cutting work and then subjecting the bar to bead blasting and buffing.

(Inventive Example 16) As Inventive Example 16, the "scattering" of toner particles, the "blade noise" and "blade wear amount" were evaluated using a sweeping system prepared by replacing the recovery roller in Inventive Example 13 with a recovery roller having a surface roughness Rz of 6.3 μm, and a load length rate of 72% in a cutting level of 30%. The recovery roller used in Inventive Example 16 was prepared by subjecting an aluminum round bar to a cutting work and then subjecting the bar to bead blasting and buffing.

(Inventive Example 17) As Inventive Example 17, the "scattering" of toner particles, the "blade noise" and "blade wear amount" were evaluated using a sweeping system prepared by replacing the recovery roller in Inventive Example 13 with a recovery roller having a surface roughness Rz of 1.6 μm, and a load length rate of 72% in a cutting level of 30%. The recovery roller used in Inventive Example 17 was prepared by subjecting an aluminum round bar to a cutting work and then subjecting the bar to grinding using a sandpaper, and buffing.

(Comparative Example 9) As Comparative Example 9, the "scattering" of toner particles, the "blade noise" and "blade wear amount" were evaluated using a sweeping system prepared by replacing the recovery roller in Inventive Example 13 with a recovery roller having a surface roughness Rz of 1.3 μm, and a load length rate of 90% in a cutting level of 30%. The recovery roller used in Comparative Example 9) was prepared by subjecting an aluminum round bar to a cutting work and then subjecting the bar to grinding using a sandpaper, and buffing.

(Comparative Example 10) As Comparative Example 10, the "scattering" of toner particles, the "blade noise" and "blade wear amount" were evaluated using a sweeping system prepared by replacing the recovery roller in Inventive Example 13 with a recovery roller having a surface roughness Rz of 3.6 μm, and a load length rate of 67.5% in a cutting level of 30%. The recovery roller used in Comparative Example 10 was prepared by subjecting an aluminum round bar to a cutting work and then subjecting the bar to bead blasting and buffing.

(Comparative Example 11) As Comparative Example 11, the "scattering" of toner particles, the "blade noise" and "blade wear amount" were evaluated using a sweeping system prepared by replacing the recovery roller in Inventive Example 13 with a recovery roller having a surface roughness Rz of 6.7 μm, and a load length rate of 55% in a cutting level of 30%. The recovery roller used in Comparative Example 11 was prepared by only subjecting an aluminum round bar to a cutting work without a surface treatment.

(Comparative Example 12) As Comparative Example 12, the "scattering" of toner particles, the "blade noise" and "blade wear amount" were evaluated using a sweeping system prepared by replacing the recovery roller in Inventive Example 13 with a recovery roller having a surface roughness Rz of 1.6 μm, and a load length rate of 63% in a cutting level of 30%. The recovery roller used in Comparative Example 12 was prepared by subjecting an aluminum round bar to a cutting work and then subjecting the bar to grinding using a sandpaper, and buffing.

(Comparative Example 13) As Comparative Example 13, the "scattering" of toner particles, the "blade noise" and "blade wear amount" were evaluated using a sweeping system prepared by replacing the recovery roller in Inventive Example 13 with a recovery roller having a surface roughness Rz of 6.7 μm, and a load length rate of 73% in a cutting level of 30%. The recovery roller used in Comparative Example 13 was prepared by subjecting an aluminum round bar to a cutting work and then subjecting the bar to bead blasting and buffing.

(Comparative Example 14) As Comparative Example 14, the "scattering" of toner particles, the "blade noise" and "blade wear amount" were evaluated using a sweeping system prepared by replacing the recovery roller in Inventive Example 13 with a recovery roller having a surface roughness Rz of 6.3 μm, and a load length rate of 65% in a cutting level of 30%. The recovery roller used in Comparative Example 14 was prepared by only subjecting an aluminum round bar to a cutting work without a surface treatment.

(Inventive Example 18) As Inventive Example 18, the "scattering" of toner particles, the "blade noise" and "blade wear amount" were evaluated using a sweeping system prepared by replacing the recovery roller in Inventive Example 13 with a recovery roller having a diameter of 7 mm or less, a surface roughness Rz of 1.6 μm, and a load length rate of 87% in a cutting level of 30%. The recovery roller used in Inventive Example 18 was prepared by subjecting an aluminum round bar to a cutting work and then subjecting the bar to grinding using a sandpaper, and buffing.

(Inventive Example 19) As Inventive Example 19, the "scattering" of toner particles, the "blade noise" and "blade wear amount" were evaluated using a sweeping system prepared by replacing the recovery roller in Inventive Example 18 with a surface roughness Rz of 3.6 μm, and a load length rate of 86% in a cutting level of 30%. The recovery roller used in Inventive Example 19 was prepared by subjecting an aluminum round bar to a cutting work and then subjecting the bar to grinding using a sandpaper, and buffing.

(Inventive Example 20) As Inventive Example 20, the "scattering" of toner particles, the "blade noise" and "blade wear amount" were evaluated using a sweeping system prepared by replacing the recovery roller in Inventive Example 18 with a recovery roller having a surface roughness Rz of 5.1 μm, and a load length rate of 75% in a cutting level of 30%. The recovery roller used in Inventive Example 20 was prepared by subjecting an aluminum round bar to a cutting work and then subjecting the bar to bead blasting and buffing.

(Inventive Example 21) As Inventive Example 21, the "scattering" of toner particles, the "blade noise" and "blade wear amount" were evaluated using a sweeping system prepared by replacing the recovery roller in Inventive Example 18 with a recovery roller having a surface roughness Rz of 6.2 μm, and a load length rate of 73% in a cutting level of 30%. The recovery roller used in Inventive Example 21 was prepared by subjecting an aluminum round bar to a cutting work and then subjecting the bar to bead blasting and buffing.

(Inventive Example 22) As Inventive Example 22, the "scattering" of toner particles, the "blade noise" and "blade wear amount" were evaluated using a sweeping system prepared by replacing the recovery roller in Inventive Example 18 with a surface roughness Rz of 1.6 μm, and a load length rate of 71% in a cutting level of 30%. The recovery roller used in Inventive Example 22 was prepared by subjecting an aluminum round bar to a cutting work and then subjecting the bar to grinding using a sandpaper, and buffing.

(Comparative Example 15) As Comparative Example 15, the "scattering" of toner particles, the "blade noise" and "blade wear amount" were evaluated using a sweeping system prepared by replacing the recovery roller in Inventive Example 18 with a recovery roller having a surface roughness Rz of 1.2 μm, and a load length rate of 91% in a cutting level of 30%. The recovery roller used in Comparative Example 15 was prepared by subjecting an aluminum round bar to a cutting work and then subjecting the bar to grinding using a sandpaper, and buffing.

(Comparative Example 16) As Comparative Example 16, the "scattering" of toner particles, the "blade noise" and "blade wear amount" were evaluated using a sweeping system prepared by replacing the recovery roller in Inventive Example 18 with a recovery roller having a surface roughness Rz of 3.4 μm, and a load length rate of 68% in a cutting level of 30%. The recovery roller used in Comparative Example 16 was prepared by subjecting an aluminum round bar to a cutting work and then subjecting the bar to bead blasting and buffing.

(Comparative Example 17) As Comparative Example 17, the "scattering" of toner particles, the "blade noise" and "blade wear amount" were evaluated using a sweeping system prepared by replacing the recovery roller in Inventive Example 18 with a recovery roller having a surface roughness Rz of 6.7 μm, and a load length rate of 56% in a cutting level of 30%. The recovery roller used in Comparative Example 17 was prepared by only subjecting an aluminum round bar to a cutting work without a surface treatment.

(Comparative Example 18) As Comparative Example 18, the "scattering" of toner particles, the "blade noise" and "blade wear amount" were evaluated using a sweeping system prepared by replacing the recovery roller in Inventive Example 18 with a recovery roller having a surface roughness Rz of 1.4 μm, and a load length rate of 63% in a cutting level of 30%. The recovery roller used in Comparative Example 18 was prepared by subjecting an aluminum round bar to a cutting work and then subjecting the bar to grinding using a sandpaper, and buffing.

(Comparative Example 19) As Comparative Example 19, the "scattering" of toner particles, the "blade noise" and "blade wear amount" were evaluated using a sweeping system prepared by replacing the recovery roller in Inventive Example 18 with a recovery roller having a surface roughness Rz of 6.8 μm, and a load length rate of 74% in a cutting level of 30%. The recovery roller used in Comparative Example 19 was prepared by subjecting an aluminum round bar to a cutting work and then subjecting the bar to bead blasting and buffing.

(Comparative Example 20) As Comparative Example 20, the "scattering" of toner particles, the "blade noise" and "blade wear amount" were evaluated using a sweeping system prepared by replacing the recovery roller in Inventive Example 18 with a recovery roller having a surface roughness Rz of 6.3 μm, and a load length rate of 66% in a cutting level of 30%. The recovery roller used in Comparative Example 20 was prepared by only subjecting an aluminum round bar to a cutting work without a surface treatment.

The results of Inventive Examples 13 to 17 and Comparative Examples 9 to 14 are shown in Table 2.

TABLE 2

REFERENCE LENGTH L: 4.0 mm
DIAMETER OF RECOVERY ROLLER: 10 mm

| | SURFACE ROUGHNESS (Rz) | LOAD LENGTH RATE WHEN CP = 30 | EVALUATION | | | | |
|---|---|---|---|---|---|---|---|
| | | | TRANSMISSION DENSITY | TONER SCATTERING | BLADE NOISE | BLADE WEAR | COMPREHENSIVE EVALUATION |
| COMPARATIVE EXAMPLE 9 | 1.3 | 90 | 0.02 | ○ | X | ○ | X |
| COMPARATIVE EXAMPLE 12 | 1.6 | 63 | 0.07 | X | ○ | ○ | X |
| EXAMPLE 17 | 1.6 | 72 | 0.04 | ○ | ○ | ○ | ○ |
| EXAMPLE 13 | 1.6 | 88 | 0.03 | ○ | ○ | ○ | ○ |
| COMPARATIVE EXAMPLE 10 | 3.6 | 67.5 | 0.06 | X | ○ | ○ | X |
| EXAMPLE 14 | 3.6 | 86 | 0.03 | ○ | ○ | ○ | ○ |
| EXAMPLE 15 | 5.2 | 75 | 0.04 | ○ | ○ | ○ | ○ |
| COMPARATIVE EXAMPLE 14 | 6.3 | 65 | 0.08 | X | ○ | ○ | X |
| EXAMPLE 16 | 6.3 | 72 | 0.05 | ○ | ○ | ○ | ○ |
| COMPARATIVE EXAMPLE 11 | 6.7 | 55 | 0.08 | X | ○ | X | X |
| COMPARATIVE EXAMPLE 13 | 6.7 | 73 | 0.02 | ○ | ○ | X | X |

The results of Inventive Examples 18 to 22 and Comparative Examples 15 to 20 are shown in Table 3. In Tables 2 and 3, Inventive Comparative Examples are re-arranged on the basis of the surface roughness (Rz).

TABLE 3

REFERENCE LENGTH L: 4.0 mm
DIAMETER OF RECOVERY ROLLER: 7 mm

| | SURFACE ROUGHNESS (Rz) | LOAD LENGTH RATE WHEN CP = 30 | EVALUATION | | | | |
|---|---|---|---|---|---|---|---|
| | | | TRANSMISSION DENSITY | TONER SCATTERING | BLADE NOISE | BLADE WEAR | COMPREHENSIVE EVALUATION |
| COMPARATIVE EXAMPLE 15 | 1.2 | 91 | 0.03 | ○ | X | ○ | X |
| COMPARATIVE EXAMPLE 18 | 1.4 | 63 | 0.07 | X | ○ | ○ | X |
| EXAMPLE 22 | 1.6 | 71 | 0.05 | ○ | ○ | ○ | ○ |
| EXAMPLE 18 | 1.6 | 87 | 0.04 | ○ | ○ | ○ | ○ |
| COMPARATIVE EXAMPLE 16 | 3.4 | 68 | 0.08 | X | ○ | ○ | X |
| EXAMPLE 19 | 3.6 | 86 | 0.03 | ○ | ○ | ○ | ○ |
| EXAMPLE 20 | 5.1 | 75 | 0.03 | ○ | ○ | ○ | ○ |
| EXAMPLE 21 | 6.2 | 73 | 0.04 | ○ | ○ | ○ | ○ |

TABLE 3-continued

| | REFERENCE LENGTH L: 4.0 mm DIAMETER OF RECOVERY ROLLER: 7 mm | | | | | | |
|---|---|---|---|---|---|---|---|
| | SURFACE | LOAD LENGTH RATE | EVALUATION | | | | |
| | ROUGHNESS (Rz) | WHEN CP = 30 | TRANSMISSION DENSITY | TONER SCATTERING | BLADE NOISE | BLADE WEAR | COMPREHENSIVE EVALUATION |
| COMPARATIVE EXAMPLE 20 | 6.3 | 66 | 0.09 | X | ○ | ○ | X |
| COMPARATIVE EXAMPLE 17 | 6.7 | 56 | 0.08 | X | ○ | X | X |
| COMPARATIVE EXAMPLE 19 | 6.8 | 74 | 0.02 | ○ | ○ | X | X |

As seen in the results of Tables 2 and 3, it was found that the surface roughness profile (a load length rate Rmr (tp) when a cutting level is 30% in a load curve) has significant large impact.

Specifically, based on Table 2, it was proved that, when the diameter is 10 mm or less, and the load length rate (Rmr) in a cutting level (CP) of 30% is 70% or more, the scattering of toner particles can be suppressed, and the recovery roller having a surface profile with some level of surface roughness can provide more enhanced toner recovery performance.

A recovery roller according to a third embodiment of the present invention will be described below. The recovery roller according to the third embodiment is different from the recovery roller according to the second embodiment in that the diameter is not 10 mm.

The recovery roller according to the third embodiment will be specifically described based on Inventive Examples thereof and Comparative Examples. As to a component or element which is not included in the following description about Inventive Examples and Comparative Examples, the same component or element as that of the printer and sweeping system in the first embodiment was used to perform evaluations.

(Inventive Example 23) A recovery roller 14 used in Inventive Example 23 was made of stainless steel, and formed to have a diameter of 14 mm, a surface roughness Rz of 1.7 μm, and a load length rate of 87% in a cutting level of 30%, differently from Inventive Example 13. This recovery roller 14 used in Inventive Example 23 was prepared by subjecting the stainless-steel round bar to a cutting work and then subjecting the bar to grinding using a sandpaper, and buffing. The surface roughness (Rz) was measured in the same manner as that in Inventive Example 1.

The recovery roller 14 was driven under the above conditions, and the "scattering" of toner particles, the "blade noise" and "wear amount" of the blade 15 were evaluated. The evaluations were performed in the same manner as those in Inventive Example 13.

(Inventive Example 24) As Inventive Example 24, the "scattering" of toner particles, the "blade noise" and "blade wear amount" were evaluated using a sweeping system prepared by replacing the recovery roller in Inventive Example 23 with a recovery roller having a surface roughness Rz of 3.7 μm, and a load length rate of 85% in a cutting level of 30%. The recovery roller used in Inventive Example 24 was prepared by subjecting an aluminum round bar to a cutting work and then subjecting the bar to grinding using a sandpaper, and buffing.

(Inventive Example 25) As Inventive Example 25, the "scattering" of toner particles, the "blade noise" and "blade wear amount" were evaluated using a sweeping system prepared by replacing the recovery roller in Inventive Example 23 with a recovery roller having a surface roughness Rz of 5.3 μm, and a load length rate of 76% in a cutting level of 30%. The recovery roller used in Inventive Example 25 was prepared by subjecting an aluminum round bar to a cutting work and then subjecting the bar to bead blasting and buffing.

(Inventive Example 26) As Inventive Example 26, the "scattering" of toner particles, the "blade noise" and "blade wear amount" were evaluated using a sweeping system prepared by replacing the recovery roller in Inventive Example 23 with a recovery roller having a surface roughness Rz of 6.3 μm, and a load length rate of 74% in a cutting level of 30%. The recovery roller used in Inventive Example 26 was prepared by subjecting an aluminum round bar to a cutting work and then subjecting the bar to bead blasting and buffing.

(Inventive Example 27) As Inventive Example 27, the "scattering" of toner particles, the "blade noise" and "blade wear amount" were evaluated using a sweeping system prepared by replacing the recovery roller in Inventive Example 23 with a recovery roller having a surface roughness Rz of 1.8 μm, and a load length rate of 73% in a cutting level of 30%. The recovery roller used in Inventive Example 27 was prepared by subjecting an aluminum round bar to a cutting work and then subjecting the bar to bead blasting and buffing.

(Comparative Example 21) As Comparative Example 21, the "scattering" of toner particles, the "blade noise" and "blade wear amount" were evaluated using a sweeping system prepared by replacing the recovery roller in Inventive Example 23 with a recovery roller having a surface roughness Rz of 1.3 μm, and a load length rate of 91% in a cutting level of 30%. The recovery roller used in Comparative Example 21 was prepared by subjecting an aluminum round bar to a cutting work and then subjecting the bar to grinding using a sandpaper, and buffing.

(Comparative Example 22) As Comparative Example 22, the "scattering" of toner particles, the "blade noise" and "blade wear amount" were evaluated using a sweeping system prepared by replacing the recovery roller in Inventive Example 23 with a recovery roller having a surface roughness Rz of 3.6 μm, and a load length rate of 67% in a cutting level of 30%. The recovery roller used in Comparative Example 22 was prepared by only subjecting an aluminum round bar to a cutting work and then subjecting the bar to grinding using a bead blasting, and buffing.

(Comparative Example 23) As Comparative Example 23, the "scattering" of toner particles, the "blade noise" and "blade wear amount" were evaluated using a sweeping system prepared by replacing the recovery roller in Inventive Example 23 with a recovery roller having a surface roughness Rz of 6.7 μm, and a load length rate of 54% in a cutting level of 30%. The recovery roller used in Comparative Example 23 was prepared by only subjecting an aluminum round bar to a cutting work without a surface treatment.

(Comparative Example 24) As Comparative Example 24, the "scattering" of toner particles, the "blade noise" and "blade wear amount" were evaluated using a sweeping system prepared by replacing the recovery roller in Inventive Example 23 with a recovery roller having a surface roughness Rz of 1.6 μm, and a load length rate of 63% in a cutting level of 30%. The recovery roller used in Comparative Example 24 was prepared by only subjecting an aluminum round bar to a cutting work and then subjecting the bar to grinding using a sandpaper, and buffing.

(Comparative Example 25) As Comparative Example 25, the "scattering" of toner particles, the "blade noise" and "blade wear amount" were evaluated using a sweeping system prepared by replacing the recovery roller in Inventive Example 23 with a recovery roller having a surface roughness Rz of 6.7 μm, and a load length rate of 74% in a cutting level of 30%. The recovery roller used in Comparative Example 25 was prepared by only subjecting an aluminum round bar to a cutting work and then subjecting the bar to bead blasting and buffing.

(Comparative Example 26) As Comparative Example 26, the "scattering" of toner particles, the "blade noise" and "blade wear amount" were evaluated using a sweeping system prepared by replacing the recovery roller in Inventive Example 23 with a recovery roller having a surface roughness Rz of 6.3 μm, and a load length rate of 65% in a cutting level of 30%. The recovery roller used in Comparative Example 26 was prepared by only subjecting an aluminum round bar to a cutting work without a surface treatment.

The results of Inventive Examples 23 to 27 and Comparative Examples 21 to 26 are shown in Table 4.

As seen in the results of Table 4, it was proved that, when the surface roughness Rz is in the range of 1.6 μm to 6.4 μm, and the load length rate (Rmr) in a cutting level (CP) of 30% is 70% or more, the scattering of toner particles can be suppressed, even if the diameter of the recovery roller is greater than 10 mm.

In the above embodiments, the intermediate transfer belt 6 has been shown as one example of an image bearing member, and the fur brush roller 13 has been designed to be separated away from the intermediate transfer belt 6. Alternatively, the fur brush roller 13 may be designed to be constantly in contact with he intermediate transfer belt 6, if there is no need to separate the fur brush roller 13 from the intermediate transfer belt 6.

Specifically, the first to third embodiments have been described based on the single-drum color printer, and thereby there is the need for separating he fur brush roller 13 from the intermediate transfer belt 6 during transfer of four-color toner images to the intermediate transfer belt 6. However, a tandem-type and monochrome-printing printers have no need for separating he fur brush roller 13. Thus, the fur brush roller 13 may be designed to be constantly in contact with he intermediate transfer belt 6. In this case, a photosensitive drum corresponds to the image bearing member of the present invention.

Further, in the first to third embodiments, the sweeping system including the aforementioned recovery roller may be applied to the cleaning unit 5 provided as a means to removing residual toner particles on the photosensitive drum.

The aforementioned first to third embodiments includes an invention having the following features.

An image forming apparatus according to one aspect of the present invention comprises an image bearing member on which a toner image is formed, a sweep roller for removing residual toner particles from the image bearing member, and a recovery roller for recovering the toner particles from the

TABLE 4

REFERENCE LENGTH L: 4.0 mm
DIAMETER OF RECOVERY ROLLER: 14 mm

| | SURFACE ROUGHNESS (Rz) | LOAD LENGTH RATE WHEN CP = 30 | EVALUATION | | | | |
|---|---|---|---|---|---|---|---|
| | | | TRANSMISSION DENSITY | TONER SCATTERING | BLADE NOISE | BLADE WEAR | COMPREHENSIVE EVALUATION |
| COMPARATIVE EXAMPLE 21 | 1.3 | 91 | 0.03 | ○ | X | ○ | X |
| COMPARATIVE EXAMPLE 24 | 1.6 | 63 | 0.08 | X | ○ | ○ | X |
| EXAMPLE 23 | 1.7 | 87 | 0.01 | ○ | ○ | ○ | ○ |
| EXAMPLE 27 | 1.8 | 73 | 0.01 | ○ | ○ | ○ | ○ |
| COMPARATIVE EXAMPLE 22 | 3.6 | 67 | 0.07 | X | ○ | ○ | X |
| EXAMPLE 24 | 3.7 | 85 | 0.01 | ○ | ○ | ○ | ○ |
| EXAMPLE 25 | 5.3 | 76 | 0.02 | ○ | ○ | ○ | ○ |
| COMPARATIVE EXAMPLE 26 | 6.3 | 65 | 0.08 | X | ○ | ○ | X |
| EXAMPLE 26 | 6.3 | 74 | 0.02 | ○ | ○ | ○ | ○ |
| COMPARATIVE EXAMPLE 23 | 6.7 | 54 | 0.08 | X | ○ | X | X |
| COMPARATIVE EXAMPLE 25 | 6.7 | 74 | 0.02 | ○ | ○ | X | X |

sweep roller. The recovery roller has a diameter of 10 mm or less, and a surface roughness Rz of 1.6 μm to 6.4 μm.

This recovery roller can suppress blade noise and reduce blade wear amount. This makes it possible to provide an image forming apparatus having a sweeping system capable of suppressing the blade noise and reduce the blade wear amount.

In the above image forming apparatus, the recovery roller preferably has a load length rate of 70% or more when a cutting level is 30% in a load curve obtained by a measurement of the surface roughness. This image forming apparatus can suppress the scattering of toner particles in addition to the above advantage.

An image forming apparatus according to another aspect of the present invention comprises an image bearing member on which a toner image is formed, a sweep roller for removing residual toner particles from the image bearing member, and a recovery roller for recovering the toner particles from the sweep roller. The recovery roller has a surface roughness Rz of 1.6 μm to 6.4 μm, and a load length rate of 70% or more when a cutting level is 30% in a load curve obtained by a measurement of the surface roughness.

This recovery roller can suppress toner scattering. This makes it possible to provide an image forming apparatus having a sweeping system capable of suppressing the toner scattering.

In the above image forming apparatus, the sweep roller preferably consists of a brush roller.

In the above image forming apparatus, the toner particles preferably have a roundness of 0.97 or more, a volume-average particle diameter of 4 μm to 8 μm, and a variation coefficient of number distribution of 26% or less. While toner particles having high roundness and low variation coefficient are apt to cause the blade noise, the present invention can effectively suppress such a problem.

Preferably, the toner particles have a charge amount of 30 μC/g or more when they are on the image bearing member. While toner particles having high charge amount are apt to cause the blade noise and blade wear, the present invention can effectively suppress such a problem.

Preferably, the image forming apparatus further comprises a blade for removing the toner particles from the recovery roller.

In this case, the image forming apparatus further preferably comprises a drive mechanism for moving a position of the sweep roller. The drive mechanism may be operable to selectively press and separate the sweep roller against/away from the image bearing member, while allowing a relative position between the blade and the recovery roller to be fixed. Preferably, the drive mechanism is further operable to swingingly move the sweep roller about a rotation axis of the recovery roller so as to be pressed against or separated away from the image bearing member.

This application is based on patent application No. 2005-361646 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

an image bearing member on which a toner image is formed;

a sweep roller for removing residual toner particles from said image bearing member; and a recovery roller for recovering the toner particles from said sweep roller, said recovery roller having a diameter of 10 mm or less, and a surface roughness Rz of 1.6 μm to 6.4 μm, wherein said recovery roller has a load length rate of 70% or more when a cutting level is 30% in a load curve obtained by a measurement of said surface roughness.

2. The image forming apparatus as defined in claim 1, wherein said sweep roller consists of a brush roller.

3. The image forming apparatus as defined in claim 1, which further comprises a blade for removing the toner particles from said recovery roller.

4. The image forming apparatus as defined in claim 3, which further comprises a drive mechanism for moving a position of said sweep roller, said drive mechanism being operable to selectively press and separate said sweep roller against/away from said image bearing member, while allowing a relative position between said blade and said recovery roller to be fixed.

5. The image forming apparatus as defined in claim 4, wherein said drive mechanism is operable to swingingly move said sweep roller about a rotation axis of said recovery roller so as to be pressed against or separated away from said image bearing member.

6. An image forming apparatus comprising:

an image bearing member on which a toner image is formed;

a sweep roller for removing residual toner particles from said image bearing member; and a recovery roller for recovering the toner particles from said sweep roller, said recovery roller having a surface roughness Rz of 1.6 μm to 6.4 μm, and a load length rate of 70% or more when a cutting level is 30% in a load curve obtained by a measurement of said surface roughness.

7. The image forming apparatus as defined in claim 6, wherein said sweep roller consists of a brush roller.

8. The image forming apparatus as defined in claim 6, which further comprises a blade for removing the toner particles from said recovery roller.

9. The image forming apparatus as defined in claim 8, which further comprises a drive mechanism for moving a position of said sweep roller, said drive mechanism being operable to selectively press and separate said sweep roller against/away from said image bearing member, while allowing a relative position between said blade and said recovery roller to be fixed.

10. The image forming apparatus as defined in claim 9, wherein said drive mechanism is operable to swingingly move said sweep roller about a rotation axis of said recovery roller so as to be pressed against or separated away from said image bearing member.

11. A recovery roller for recovering toner particles from a sweep roller for removing residual toner particles, said recovery roller having a diameter of 10 mm or less, and a surface roughness Rz of 1.6 μm to 6.4 wherein the recovery roller has a load length rate of 70% or more when a cutting level is 30% in a load curve obtained by a measurement of said surface roughness.

12. A recovery roller for recovering toner particles from a sweep roller for removing residual toner particles, said recovery roller having a surface roughness Rz of 1.6 μm to 6.4 μm, and a load length rate of 70% or more when a cutting level is 30% in a load curve obtained by a measurement of said surface roughness.

13. A toner particle configured to be used for an image forming apparatus including an image bearing member on which a toner image is formed, a sweep roller for removing residual toner particles from said image bearing member, and a recovery roller with a surface roughness Rz of 1.6 μm to 6.4 μm for recovering the toner particles from said sweep roller, comprising:

a roundness of 0.97 or more;

a volume-average particle diameter of 4 μm to 8 μm; and a variation coefficient of number distribution of 26% or less, wherein said toner particle has a charge amount of 30 μC/g or more on said image bearing member.

* * * * *